US011884465B2

(12) United States Patent
Ehyai et al.

(10) Patent No.: US 11,884,465 B2
(45) Date of Patent: Jan. 30, 2024

(54) HYDRATION RESERVOIR

(71) Applicant: Samsonite IP Holdings S.a r.l., Luxembourg (LU)

(72) Inventors: Rawmin Ehyai, Salt Lake City, UT (US); John Bemis Sears, Salt Lake City, UT (US); Tabita Verumen, Salt Lake City, UT (US)

(73) Assignee: Samsonite IP Holdings S.a r.l., Luxembourg (LU)

( * ) Notice: Subject to any disclaimer, the term of this patent is extended or adjusted under 35 U.S.C. 154(b) by 0 days.

(21) Appl. No.: 17/681,921

(22) Filed: Feb. 28, 2022

(65) Prior Publication Data

US 2022/0234802 A1 Jul. 28, 2022

Related U.S. Application Data

(63) Continuation of application No. 16/416,416, filed on May 20, 2019, now Pat. No. 11,279,536, which is a continuation of application No. 15/134,724, filed on Apr. 21, 2016, now Pat. No. 10,315,816.

(60) Provisional application No. 62/234,565, filed on Sep. 29, 2015.

(51) Int. Cl.

| | |
|---|---|
| ***B65D 55/16*** | (2006.01) |
| ***A45F 3/04*** | (2006.01) |
| *A45F 3/16* | (2006.01) |

(52) U.S. Cl.

CPC ..... *B65D 55/165* (2013.01); *A45F 3/04* (2013.01); *A45F 2003/166* (2013.01)

(58) Field of Classification Search

CPC ..... B65D 55/165; A45F 3/04; A45F 2003/166
USPC ..... 383/13
See application file for complete search history.

(56) References Cited

U.S. PATENT DOCUMENTS

| | | | | |
|---|---|---|---|---|
| 1,726,761 | A | 9/1929 | Palmer | |
| 1,959,782 | A | 5/1934 | Fenwick, Jr. et al. | |
| 2,049,220 | A | 7/1936 | Pearce | |
| 2,834,345 | A * | 5/1958 | Tabbert | A61J 1/10 383/96 |
| 3,299,442 | A | 1/1967 | White et al. | |
| 3,814,288 | A | 6/1974 | Westrich | |
| 4,254,771 | A | 3/1981 | Vidal | |
| 4,526,298 | A | 7/1985 | Boxer et al. | |
| 4,732,299 | A | 3/1988 | Hoyt | |

(Continued)

FOREIGN PATENT DOCUMENTS

| | | |
|---|---|---|
| CN | 202987773 U | 6/2013 |
| DE | 9408454 U | 9/1994 |

(Continued)

OTHER PUBLICATIONS

Osprey, "3 Liter Hydraulics Reservoir", Obtained at url: http://www.ospreypacks.com/en/product/cycling/hydraulics_reservoir_3_liter, known as early as Oct. 19, 2015, 3 pages.

(Continued)

*Primary Examiner* — Jes F Pascua
(74) *Attorney, Agent, or Firm* — Dorsey & Whitney LLP

(57) ABSTRACT

A hydration reservoir is provided. The hydration reservoir may include at least two panels of resilient material joined together at edges to define a bladder and a bladder volume for storing a liquid. The at least two panels may be deformable as the bladder is emptied of liquid. One of the at least two panels may be molded into a three-dimensional shape.

9 Claims, 13 Drawing Sheets

(56) References Cited

U.S. PATENT DOCUMENTS

| | | | | |
|---|---|---|---|---|
| 4,836,416 | A | 6/1989 | Shalgi et al. | |
| D308,632 | S | 6/1990 | Fick | |
| 4,938,747 | A * | 7/1990 | Wallace | A61F 5/44 604/323 |
| 5,364,189 | A | 11/1994 | Kuge et al. | |
| 5,727,714 | A | 3/1998 | Fawcett | |
| 5,806,726 | A | 9/1998 | Ho | |
| 5,806,904 | A | 9/1998 | Smith | |
| 5,913,456 | A | 6/1999 | Dikeman | |
| 6,032,831 | A | 3/2000 | Gardner et al. | |
| 6,142,344 | A | 11/2000 | Kai | |
| 6,164,821 | A | 12/2000 | Randall | |
| D443,980 | S | 6/2001 | Stewart | |
| D447,413 | S | 9/2001 | Ducorday | |
| 6,296,388 | B1 | 10/2001 | Galomb et al. | |
| 6,385,992 | B1 | 5/2002 | Flore | |
| 6,457,863 | B1 | 10/2002 | Vassallo | |
| 6,722,533 | B2 | 4/2004 | Skillern | |
| 6,854,888 | B1 | 2/2005 | Brown et al. | |
| D505,540 | S | 5/2005 | Lien | |
| 6,908,015 | B2 | 6/2005 | Choi et al. | |
| D517,308 | S | 3/2006 | Khalifa | |
| 7,014,077 | B2 | 3/2006 | Brown | |
| 7,073,688 | B2 | 7/2006 | Choi et al. | |
| D538,030 | S | 3/2007 | Karl et al. | |
| D539,027 | S | 3/2007 | Gressock et al. | |
| D539,028 | S | 3/2007 | Robins et al. | |
| D548,612 | S | 8/2007 | Berman | |
| D550,570 | S | 9/2007 | Berman | |
| 7,311,231 | B2 | 12/2007 | Noell et al. | |
| D558,601 | S | 1/2008 | Berman | |
| D567,897 | S | 4/2008 | Hillhouse | |
| 7,398,891 | B2 | 7/2008 | Yang | |
| D581,152 | S | 11/2008 | Karl et al. | |
| 7,490,740 | B2 | 2/2009 | Robins et al. | |
| D590,043 | S | 4/2009 | Campbell | |
| 7,568,673 | B2 | 8/2009 | Evingson | |
| 7,600,657 | B2 | 10/2009 | Wang | |
| D609,773 | S | 2/2010 | Abernethy et al. | |
| 7,762,432 | B2 | 7/2010 | Fidrych et al. | |
| 7,806,300 | B1 | 10/2010 | Noell et al. | |
| 7,820,946 | B2 | 10/2010 | Woodfill et al. | |
| D640,466 | S | 6/2011 | Staton | |
| D643,906 | S | 8/2011 | Kendall et al. | |
| 8,020,730 | B2 | 9/2011 | Liang et al. | |
| 8,142,075 | B2 | 3/2012 | Shaw | |
| 8,177,097 | B2 | 5/2012 | Duran | |
| 8,267,283 | B2 | 9/2012 | Staton | |
| D671,841 | S | 12/2012 | Mcclellan et al. | |
| 8,322,923 | B2 | 12/2012 | Gum | |
| D677,123 | S | 3/2013 | Kemp et al. | |
| D683,018 | S | 5/2013 | Herivel et al. | |
| 8,820,579 | B2 | 9/2014 | Wood | |
| 8,887,962 | B2 | 11/2014 | Goodner et al. | |
| 9,302,822 | B2 | 4/2016 | Hoskins | |
| D806,476 | S | 1/2018 | Karl, IV et al. | |
| D830,050 | S | 10/2018 | Gordon | |
| 10,315,816 | B2 | 6/2019 | Ehyai et al. | |
| D888,553 | S | 6/2020 | Pintar | |
| D903,298 | S | 12/2020 | Favela et al. | |
| 11,279,536 | B2 | 3/2022 | Ehyai et al. | |
| 2003/0094464 | A1 | 5/2003 | Decottignies | |
| 2004/0211778 | A1 | 10/2004 | Lien et al. | |
| 2004/0217117 | A1 | 11/2004 | Lien | |
| 2006/0151534 | A1 | 7/2006 | Mares | |
| 2007/0012733 | A1 | 1/2007 | Horito et al. | |
| 2007/0223842 | A1 | 9/2007 | Sabounjian et al. | |
| 2007/0280565 | A1 | 12/2007 | Lyon et al. | |
| 2008/0002917 | A1 | 1/2008 | Wang | |
| 2009/0236341 | A1 | 9/2009 | McKinney et al. | |
| 2010/0012221 | A1 | 1/2010 | Lien | |
| 2011/0006084 | A1 | 1/2011 | Staton | |
| 2011/0132932 | A1 | 6/2011 | Duran | |
| 2011/0290798 | A1 | 12/2011 | Corbett | |
| 2012/0111876 | A1 | 5/2012 | Pfotenhauer | |
| 2014/0374413 | A1 | 12/2014 | Lyon et al. | |
| 2015/0016753 | A1 | 1/2015 | Batarseh | |
| 2015/0076180 | A1 | 3/2015 | Hoskins | |
| 2015/0093052 | A1 | 4/2015 | Hoskins | |
| 2016/0113379 | A1 | 4/2016 | Marui | |
| 2016/0236826 | A1* | 8/2016 | Hoskins | B65D 33/1675 |
| 2017/0086568 | A1 | 3/2017 | Ehyai et al. | |
| 2019/0270562 | A1 | 9/2019 | Ehyai et al. | |
| 2020/0229578 | A1 | 7/2020 | Hoskins | |
| 2020/0352311 | A1 | 11/2020 | Garvey et al. | |

FOREIGN PATENT DOCUMENTS

| | | | | |
|---|---|---|---|---|
| EM | 0084829470001 | | 3/2021 | |
| EM | 0084829470002 | | 3/2021 | |
| EM | 0084829470003 | | 3/2021 | |
| JP | 2002136573 | A | 5/2002 | |
| JP | 3594280 | B2 | 11/2004 | |
| WO | WO-2010151848 | A2 * | 12/2010 | A45F 3/04 |
| WO | 2011003110 | A2 | 1/2011 | |
| WO | 2015047213 | A1 | 4/2015 | |
| WO | 2015098920 | A1 | 7/2015 | |

OTHER PUBLICATIONS

Osprey, "Hydraulics Reservoir Review", Obtained at url: http://www.outdoorgearlab.com/Hydration-Bladder-Reviews/Osprey-Hydraulics-Reservoir, known as early as Oct. 19, 2015, 6 pages.

* cited by examiner

HYDRATION RESERVOIR

CROSS-REFERENCE TO RELATED APPLICATIONS

This application is a continuation of U.S. patent application Ser. No. 16/416,416 filed on 20 May 2019 and entitled "Hydration Reservoir", which is a continuation of U.S. patent application Ser. No. 15/134,724 filed on 21 Apr. 2016 and entitled "Hydration Reservoir", now U.S. Pat. No. 10,315,816, which claims the benefit of priority under 35 U.S.C. § 119(e) of U.S. provisional patent application No. 62/234,565 filed 29 Sep. 2015 entitled "Quick Drying Hydration Reservoir," which are hereby incorporated herein in their entirety.

TECHNICAL FIELD

The present disclosure relates generally to hydration reservoirs, and more specifically to hydration systems with features allowing for quick or complete drying of the hydration reservoir.

BACKGROUND

Hydration reservoirs typically are constructed of multiple layers of film that abut or extend closely adjacent one another when the reservoir is empty. For example, current hydration systems on the market tend to use two pieces of flat film welded to each other along confronting peripheral edges allowing very little physical space between them when the reservoir is empty. A common challenge that consumers face with such hydration systems is the length of time it takes for the system to dry out after use and the subsequent bacteria growth and accompanying odors associated with a slow (or non) drying hydration system. Because the layers of film of existing systems are flat, the layers tend to press against one another and retain pockets of moisture, creating an ideal environment for bacteria growth and preventing the reservoir from drying without assistance from additional devices or accessories.

It is therefore desirable to provide an improved hydration system, and more specifically an improved quick drying hydration reservoir that addresses the above described problems and/or which more generally offers improvements or an alternative to existing arrangements.

SUMMARY

According to the present disclosure there is therefore provided a hydration reservoir as described below and defined in the accompanying claims. The present disclosure advantageously provides a deformable hydration reservoir that maintains its shape during drying. As explained in detail below, through use of a molded front panel, the reservoir may quickly and easily air dry without the assistance of additional devices or accessories. In this manner, a user can effectively dry the reservoir in a reasonable amount of time to reduce the bacteria growth and resulting odor, and eliminate or reduce the need to purchase or craft a homemade solution to assist the drying, which is a common practice and frustration with current systems on the market.

Embodiments of the present disclosure may include a hydration reservoir. The hydration reservoir may include at least two panels of resilient material joined together at edges to define a bladder and a bladder volume for storing a liquid. The at least two panels may be deformable as the bladder is emptied of liquid. At least one of the at least two panels may be molded into a three-dimensional shape.

Embodiments of the present disclosure may include a molded bladder for a hydration system. The bladder may include a front panel and a rear panel, the front and rear panels joined together along a line of connection, such as along their respective edges to define a bladder volume for storing liquid. The front and rear panels may deform as liquid is removed from the bladder. At least a portion of one or both of the front and rear panels may retain a three-dimensional shape when the bladder is empty.

Embodiments of the present disclosure may include a hydration reservoir. The hydration reservoir may include a flexible bladder having a top edge and opposing side edges extending from the top edge, and a clip member, which may be rigid, connected to the top edge of the bladder, the clip member extending along the top edge and at least partially down the opposing side edges of the bladder.

Embodiments of the present disclosure may include a hydration reservoir. The hydration reservoir may include a flexible bladder, the bladder including a fill opening and an outlet port spaced away from the fill opening. The outlet port is for connecting to an outlet through which the user receives the fluid stored in the bladder. The hydration reservoir may include a securement member mounted adjacent the outlet port to move relative to the outlet port and the bladder. The securement member may be a hook rotatably mounted relative to the outlet port.

Additional embodiments and features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure. One of skill in the art will understand that each of the various aspects and features of the disclosure may advantageously be used separately in some instances, or in combination with other aspects and features of the disclosure in other instances.

BRIEF DESCRIPTION OF THE DRAWINGS

The description will be more fully understood with reference to the following figures in which components are not drawn to scale, which are presented as various embodiments of the disclosure and should not be construed as a complete recitation of the scope of the disclosure, characterized in that.

DETAILED DESCRIPTION

Figure 1:
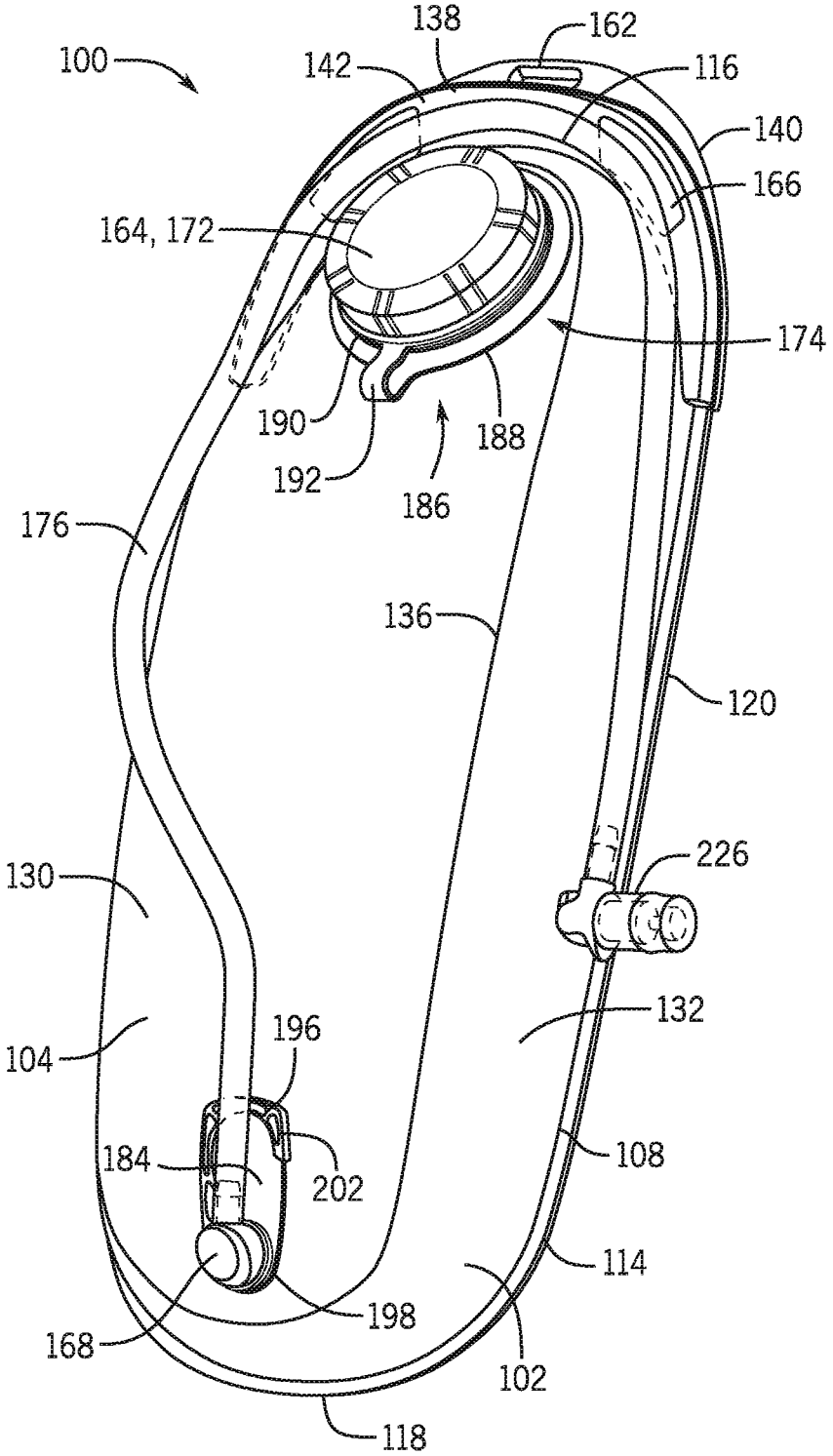
FIG. 1 is a front isometric view of a hydration reservoir in accordance with some examples of the present disclosure.
Figure 7:
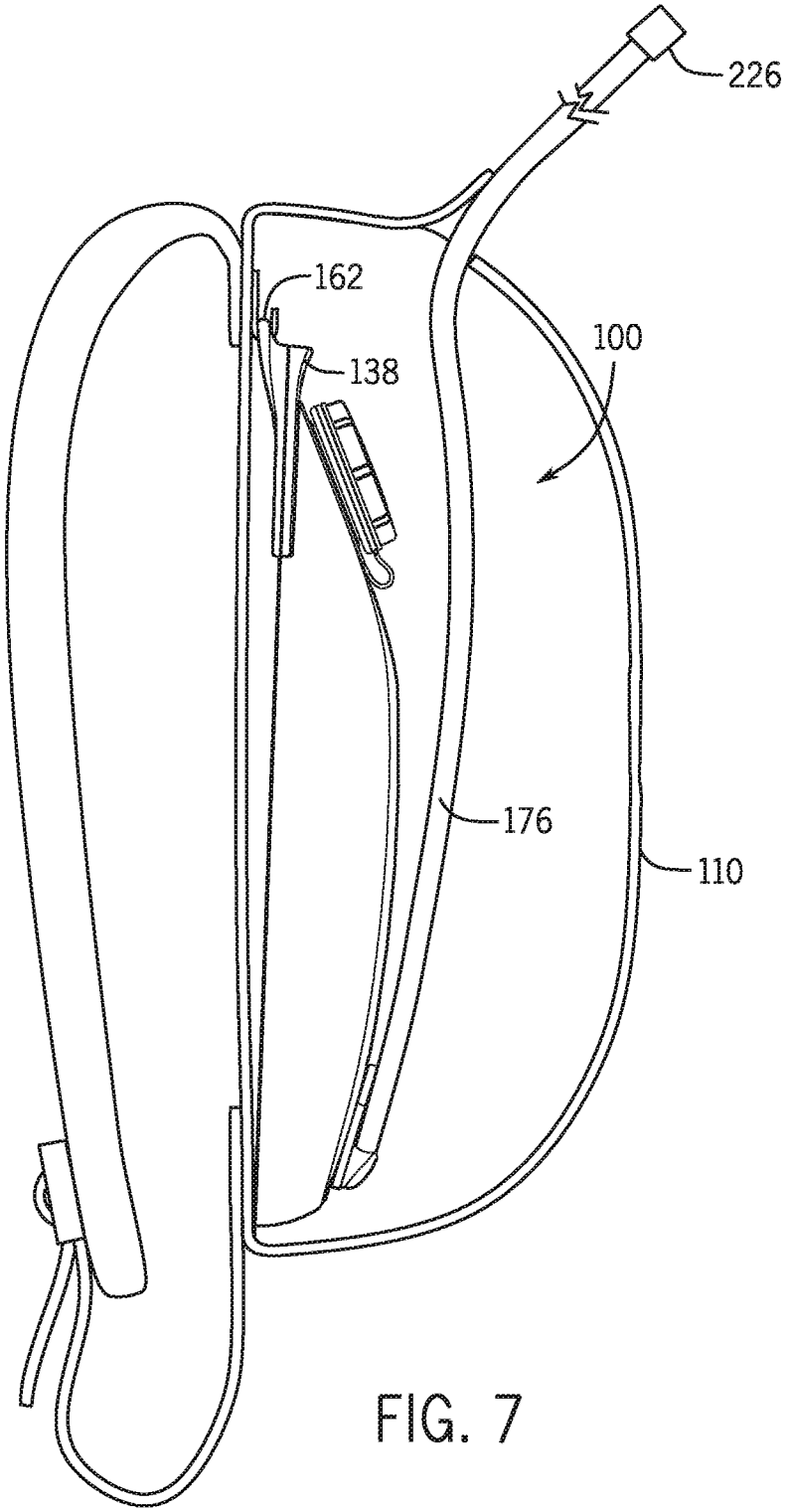
FIG. 7 is a cross-sectional view of the hydration reservoir of FIG. 1 inserted within a backpack in accordance with some examples of the present disclosure.

Referring to FIG. 1, a hydration reservoir 100 according to an embodiment of the present disclosure includes a bladder 102 formed from at least two panels (e.g. a front panel 104 and a rear panel 106) of resilient material secured together. For example, the bladder 102 may be formed by adhering the front and rear panels 104, 106 to each other along an engagement line 108, forming a seal, to create a bladder 102 that can contain liquids for consumption while performing sport activities, for instance. The front and rear panels 104, 106 may each be formed from one or more layers of flexible film, each layer of film ranging from about 0.10 mil to about 0.40 mil thick. In the embodiment of FIG. 1, the engagement line 108 forming the seal between the front and rear panels 104, 106 defines the periphery of a bladder volume, and in this example are joined together at the respective peripheral edges to define the bladder 102 and a bladder volume for storing drink fluid therein, such as water, sports drinks, and juices. The size and shape of the bladder 102 may vary depending on the desired application with which the hydration reservoir 100 will be used. For example, the hydration reservoir 100 may be placed in a hydration pack 110 or other carrier to hold and dispense fluid to a user when desired (see FIG. 7). Typically, the bladder 102 may hold at least 24 ounces, and may hold as much as 32 ounces, 50 ounces, 70 ounces, 100 ounces, 200 ounces, or more of drink fluid. In some embodiments, the front and rear panels 104, 106 may deform as the bladder 102 is emptied of liquid to, for example, limit the buildup of vacuum pressure within the bladder 102 and limit sloshing of the drink fluid within the bladder 102.

With continued reference to FIG. 1, the hydration reservoir 100 may be shaped to create a space 112 between the inner surfaces of each panel when the bladder 102 is empty (see FIG. 5), which reduces the contact between the front and rear panels 104, 106, especially when the hydration reservoir 100 is empty, thus allowing for more efficient drying of the reservoir. For example, at least one of the front and rear panels 104, 106 may be molded into a three-dimensional shape to space at least a portion of the front and rear panels 104, 106 away from each other when the bladder 102 is empty. The molded shape may encompass all or only a part of one or both of the front and rear panels 104, 106. In some embodiments, the front and/or rear panels 104, 106 may be molded (such as through vacuum or thermoforming) such that the side of either formed panel facing or adjacent to the side of the other panel has a substantially concave shape when the bladder 102 is at rest. For example, the front panel 104 may be molded such that the side of the front panel 104 facing or adjacent to the side of the rear panel 106 has a substantially concave shape when the bladder 102 is sitting at rest. In such embodiments, one panel (e.g., the rear panel 106) may be substantially flat to limit barreling into a back panel of a hydration pack 110 or into the back of a user.

Although the front panel 104 may be molded into a three-dimensional shape, both the front and rear panels 104, 106 are resiliently deformable and flexible, and in some embodiments, the rear panel 106 may be more flexible than the front panel 104, or vice versa. Due to the deformability of the front and rear panels 104, 106, the space 112 between the front and rear panels 104, 106 may be reduced as a user removes air and/or liquid from the bladder 102, greatly reducing any sloshing effect compared to a hard-molded reservoir. Although deformation of the bladder 102 may cause the front panel 104 to contact the rear panel 106 during use, when the hydration reservoir 100 is empty, the three-dimensional shape of the front panel 104 resiliently biases the front panel 104 away from the rear panel 106 to create a space 112 between the two panels 104, 106, the space 112 being formed over the entirety of the confronting internal surfaces, or over at least a portion of the confronting internal surfaces, of the front and rear panels 104, 106. This resilient biasing effect is created by the curved structure of the formed panel (e.g., the front panel 104). The space 112 or gap limits or inhibits the front and rear panels 104, 106 from touching each other, and increases the ability of air to flow within the interior of the bladder 102 to evaporate residual liquids, thereby decreasing the likelihood of bacteria growth and increasing the rate at which the hydration reservoir 100 dries out after use. The three-dimensional shape of the front panel 104, in this example, may also limit the bladder 102 from expanding towards the back of a user. It should be noted that while the formed panel(s) 104, 106 are biased apart from one another when the bladder 102 is empty, because the panels 104, 106 are also flexible to reduce water movement, they may be forced into contact with one another by a compressive force sufficient to overcome the resiliently biased expansion force. This compressive force may occur typically during use, such as by the bladder 102 being under a heavier object such as a boot or loaded backpack. When the compressive force is removed, the resiliently biased formed panel (e.g., the front panel 104) may automatically expand to its formed shape and create the internal space 112 or gap. Although described with reference to the front panel 104, additionally or alternatively, the rear panel 106 may be molded into a three-dimensional shape (e.g., having a large radius curve) in a similar manner.

Figure 2:
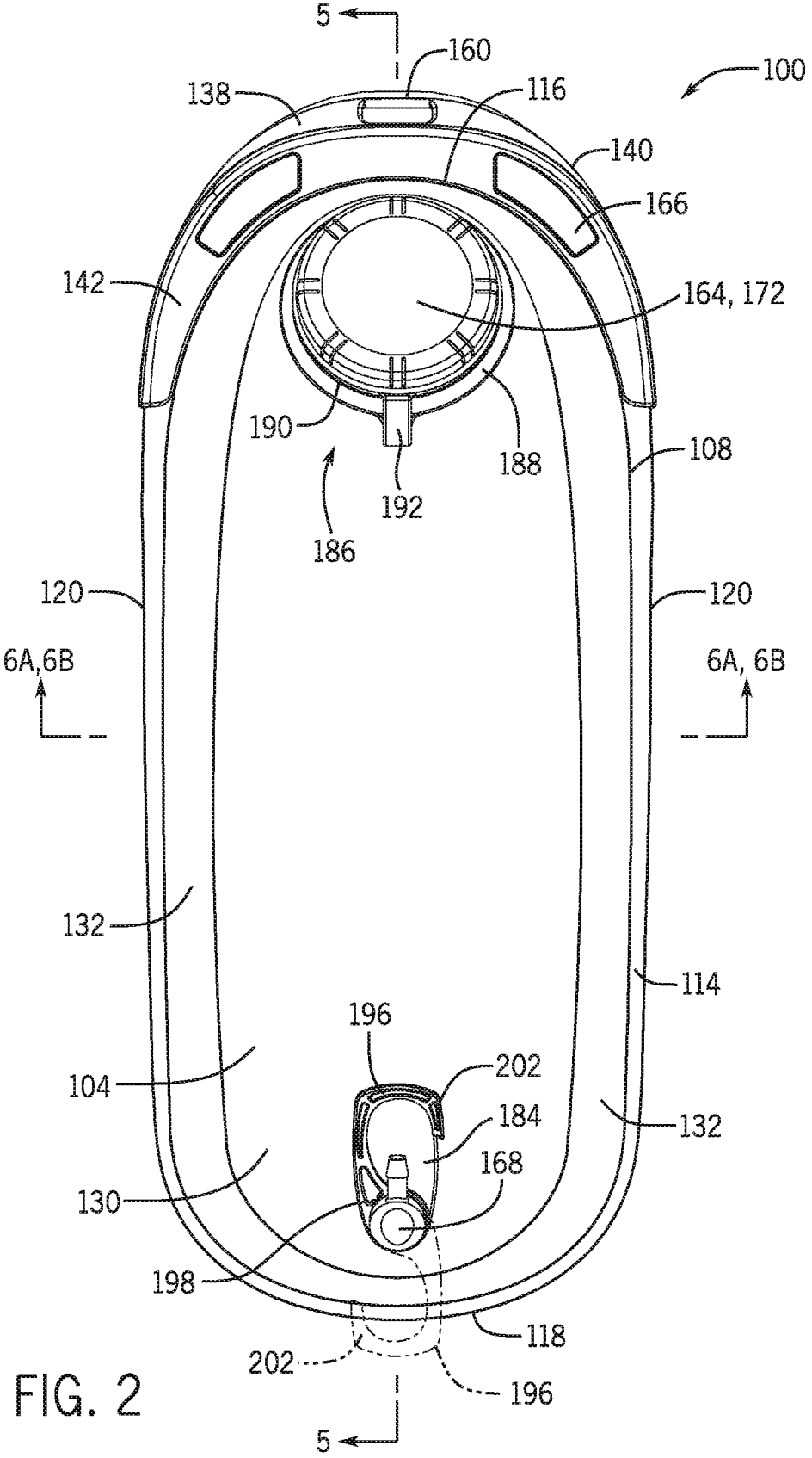
FIG. 2 is a front elevation view of the hydration reservoir of FIG. 1 in accordance with some examples of the present disclosure.
Figure 3:
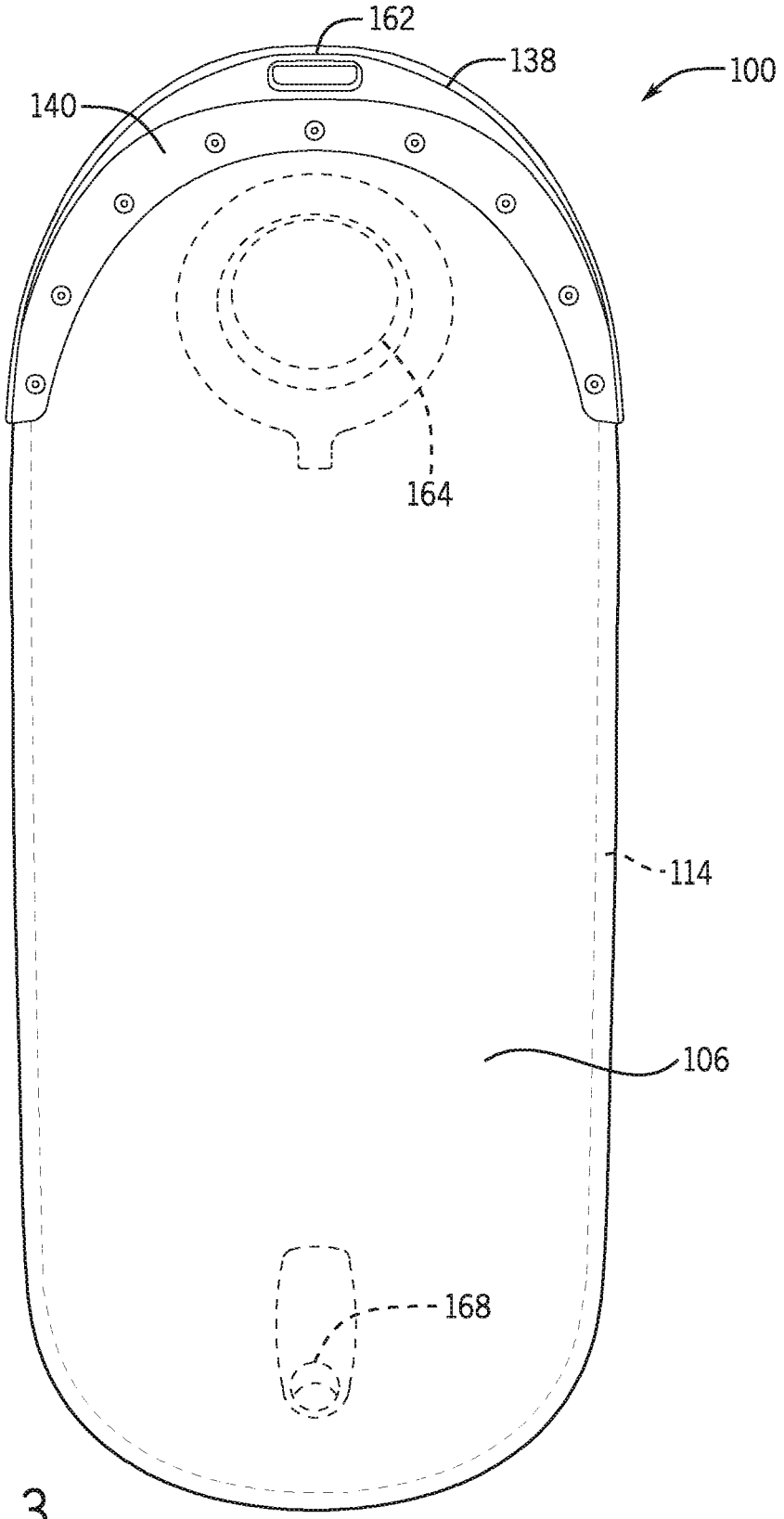
FIG. 3 is a rear elevation view of the hydration reservoir of FIG. 1 in accordance with some examples of the present disclosure.

With reference to FIGS. 1-3, once the front panel 104 is soft-molded into a desired shape, the front panel 104 and the rear panel 106 may be welded or otherwise hermetically sealed together along a line of connection (i.e., the engagement line 108), such as around their respective peripheries, to define the bladder 102. For example, the outer edge of the front panel 104 (see FIG. 1) may be welded to the confronting adjacent outer edge of the rear panel 106 (see FIG. 3) to form a leak-proof seal, which forms a flange 114 extending around the periphery of the bladder 102. When assembled, the flange 114 defines a top edge 116, a bottom edge 118, and opposing side edges 120 of the bladder 102, with the opposing side edges 120 extending between the top edge 116 and the bottom edge 118.

Figure 6A:
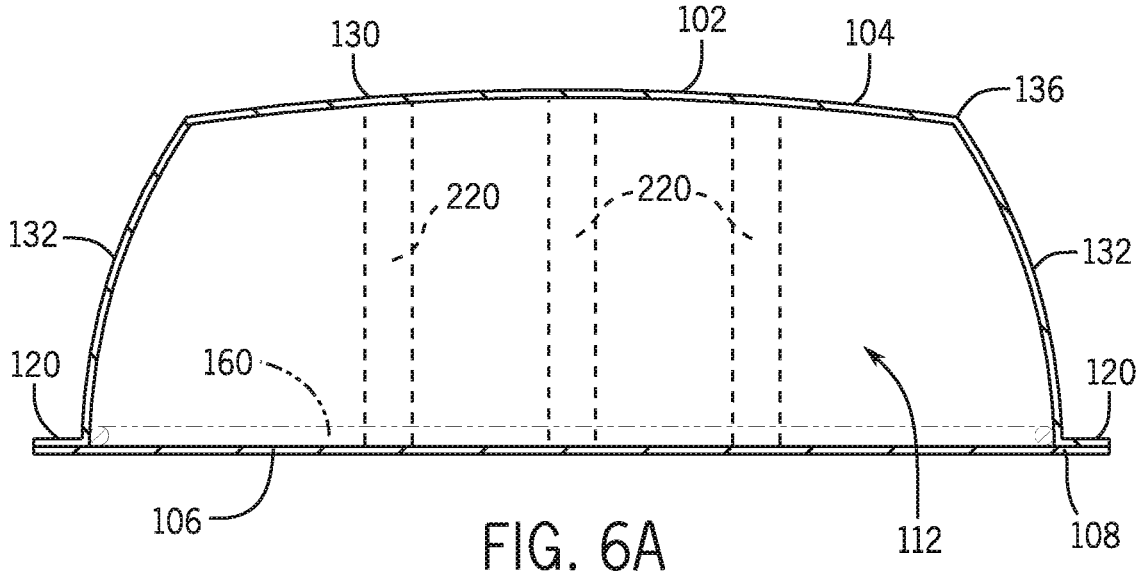
FIG. 6A is a cross-sectional view of the hydration reservoir of FIG. 1 taken along line 6A-6A of FIG. 2 in accordance with some examples of the present disclosure.
Figure 12:
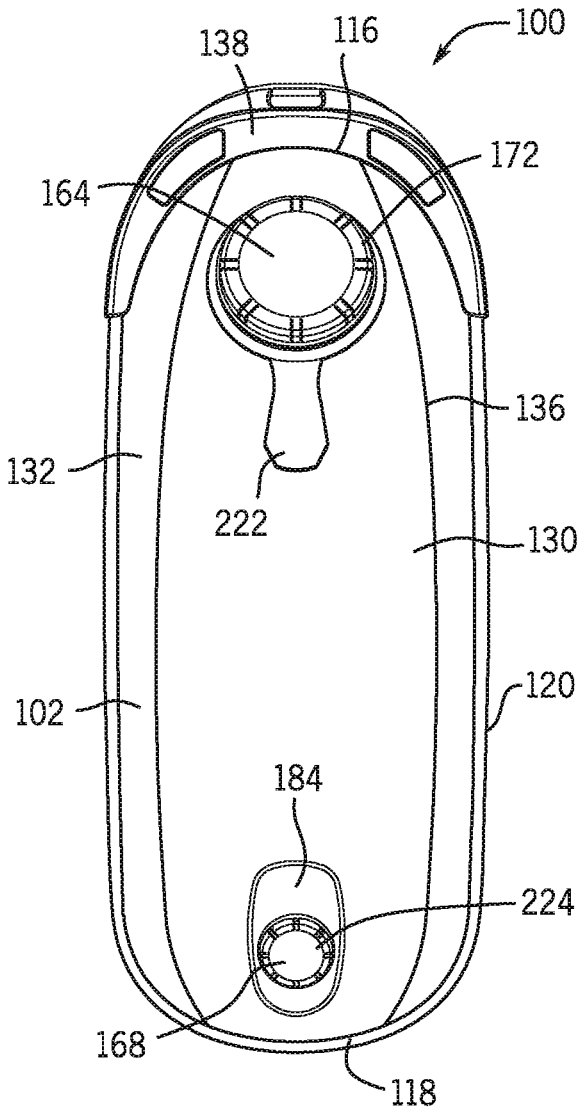
FIG. 12 is a front elevation view of an additional hydration reservoir in accordance with some examples of the present disclosure.

In some embodiments, the front panel 104 may be formed from a plurality of panel portions connected together. For example, as shown in FIGS. 1-2, the front panel 104 may be formed from a center panel portion 130 and a plurality of side panel portions 132. As shown, the side panel portions 132 extend adjacent the opposing side edges 120 of the bladder 102 to the center panel portion 130. As best seen in FIG. 6A, the center panel portion 130 may extend substantially parallel to, and at a distance spaced away from, the rear panel 106. With reference to FIG. 12, in some embodiments, the center panel portion 130 may be connected to the top and bottom edges 116, 118 of the bladder 102. On one embodiment, the center panel portion 130 may be sized smaller than the rear panel 106 such that the side panel portions 132 extend, at least partially, from the opposing side edges 120 of the bladder 102 to the center panel portion 130 at an acute angle relative to the rear panel 106 (see FIG. 6A). Similarly, the side panel portions 132 may extend from the top and bottom edges 116, 118 of the bladder 102 to the center panel portion 130 at an acute angle relative to the rear panel 106 (see FIG. 4). The side panel portions 132 may be generally planar, or may be generally curved, in which case they approximate an acute angle. In embodiments wherein the center panel portion 130 is connected directly to the top and bottom edges 116, 118, the center panel portion 130 may extend from the top and bottom edges 116, 118 at an acute angle relative to the rear panel 106. In each of the embodiments described above, the center panel portion 130 and the side panel portions 132 may be staggered and joined in an overlapping arrangement so as to form a step 134 (see FIG. 6B). In such embodiments, the center panel portion 130 may be connected to either an exterior surface or an interior surface of the side panel portions 132. Although described with reference to the front panel 104, additionally or alternatively, the rear panel 106 may be constructed from a plurality of panel portions in a similar manner. The front and rear panels 104, 106 may also each be formed from a unitary sheet, or may be formed as portions of a unitary sheet of material, with one portion being molded into the formed three-dimensional shape.

The shape of the three-dimensional formed panel, whether the front panel 104 and/or the rear panel 106, across a length dimension may be a continuous curve from the top edge 116 to the bottom edge 118 (see, e.g., FIG. 12). The curve may not be continuous, and instead be a combination of curved sidewalls extending upwardly from the edges 116, 118 forming a peripheral rim 136 (see FIGS. 1 and 6A), with a relatively planar, flat or somewhat curved top portion, such as the center panel portion 130 noted above extending across the open end of the rim 136 formed by the sidewalls. Similarly, the shape may be symmetrical or asymmetrical. The shape of the three-dimensional formed panel, whether the front panel 104 and/or the rear panel 106, across a width dimension may be a continuous curve from one side edge 120 to the other side edge 120. The curve may not be continuous, and instead be a combination of curved sidewalls extending upwardly from the edges 120 forming the peripheral rim 136, with a relatively planar, flat or somewhat curved top portion, such as the center panel portion 130 noted above extending across the open end of the rim 136 formed by the sidewalls. The shape may be symmetrical or asymmetrical.

The space 112 or gap between the front and rear panels 104, 106 as a result of the formed three-dimensional shape may be consistent, or vary, across the length and width of the bladder 102. For instance, the space 112 may be greater nearer the top edge 116 of the bladder 102 than the bottom edge 118 of the bladder 102 (see FIG. 5). Additionally or alternatively, the space 112 may be greater near the center of the width of the bladder 102 than near the opposing side edges 120 of the bladder 102 (see FIG. 6A).

With reference to FIGS. 1-4 and 8, the hydration reservoir 100 may include a clip member 138 connected to at least the top edge 116 of the bladder 102. As shown, the clip member 138 extends along the top edge 116 and at least partially down the opposing side edges 120 of the bladder 102 to provide strength and to maintain the shape of the hydration reservoir 100, for instance. In some embodiments, the clip member 138 may extend along a portion of the length of each of the opposing side edges 120, such as less than 50%, less than 40%, less than 30%, less than 20%, less than 10%, or 0%. In such embodiments, at least a portion of the clip member 138 may extend below the fill opening 164 along the opposing side edges 120 of the bladder 102. Generally, the further down the sidewalls that the clip extends, the more stability and strength that the clip provides the bladder along its length, and enhances the manipulation of the bladder by the user when it is empty as well as full.

Figure 8:
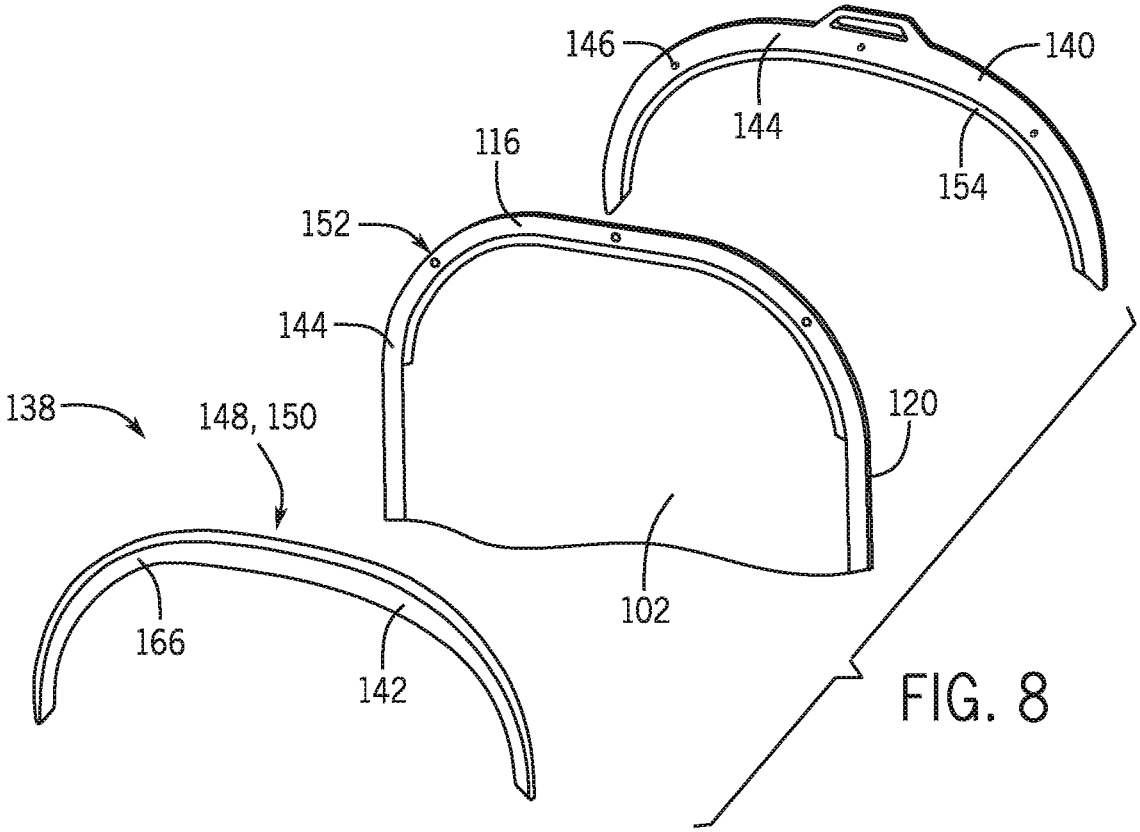
FIG. 8 is an enlarged, exploded fragmentary view of the hydration reservoir of FIG. 1 in accordance with some examples of the present disclosure.

As best illustrated in FIG. 8, the clip member 138, which may be referred to as a frame or a handle, is elongated and rigid or semi-rigid, and may include a first member 140 and a second member 142, the first and second members 140, 142 connected together to position the clip member 138 adjacent the top edge 116 of the bladder 102. In the embodiment of FIG. 8, the first member 140 includes an engagement surface 144 from which a plurality of projections 146 extends. The second member 142 includes a corresponding engagement surface 148 in which a plurality of cavities 150 are defined, the cavities 150 sized to receive and selectively retain the projections 146 of the first member 140 to secure the first member 140 to the second member 142. In some embodiments, retention holes 152 may be defined in the top edge 116 and/or the opposing side edges 120 of the bladder 102, such as in the flange 114 extending around the periphery of the bladder 102. In such embodiments, the retention holes 152 are sized to receive the projections 146 of the first member 140 to both position and retain the clip member 138 relative to the bladder 102.

To secure the clip member 138 to the bladder 102, the first member 140 is positioned adjacent the rear panel 106 such that the projections 146 of the first member 140 extend through the retention holes 152 of the bladder 102. The second member 142 is positioned adjacent the front panel 104 such that the projections 146 of the first member 140 are received in the cavities of the second member 142. As noted above, the cavities may selectively retain the projections 146 of the first member 140 (e.g., through interference fit) such that the first and second members 140, 142 are secured together. As illustrated in FIG. 8, in some embodiments, the first and second members 140, 142 may include a weld flange 154 to permanently secure the first and second members 140, 142 to the bladder 102. Once the clip member 138 is secured to the bladder 102, the top edge 116 and at least a portion of the opposing side edges 120 of the bladder 102 may be positioned substantially between the first and second members 140, 142 of the clip member 138 and may engage the engagement surfaces 144, 148 of the first and second members 140, 142. In some embodiments, the clip member 138 may extend around the entire periphery of the bladder 102 and, in such embodiments, may be formed integrally with a perimeter frame 160 (see FIG. 10). Since the clip member 138 is rigid or semi-rigid, it may structurally support the weight of the bladder when empty, and/or optionally when it is partially filled with liquid or entirely filled with liquid. Such support provides the user adequate control of the hydration reservoir to insert it into and extract it from a tight-fitting sleeve in a carrier, such as a backpack, easily hold the reservoir in a desired orientation for filling or emptying the reservoir, among other acts.

As shown in FIGS. 1-5 and 8, the clip member 138 may be configured to provide a desired aesthetic characteristic and better position the hydration reservoir 100 within a hydration pack 110 or other carrier. For example, the rigidity of the clip member 138 may assist in positioning the hydration reservoir 100 in a hydration pack 110, backpack, or other carrier (see FIG. 7). Furthermore, the clip member 138 may be curved and, in some embodiments, may include a hanger element 162 for attachment of the hydration reservoir 100 to a hydration pack 110, backpack, or other suitable carrier. The hanger element 162 may be formed in one of the first and second members 140, 142 (e.g., the first member 140) of the clip member 138 so the hydration reservoir 100 hangs properly within hydration pack 110 (see FIG. 7). In the embodiments of FIGS. 1, 2, and 8, the hanger element 162, which may or may not form a closed loop with the first member 140, is molded monolithically with the first member 140 of the clip member 138 for increased strength and ease of assembly. In some embodiments, the clip member 138 may allow a user to grip and hold the hydration reservoir 100 when, for example, filling the bladder 102 with liquid through a fill opening 164. In such embodiments, the clip member 138 may include a high friction surface treatment 166 to reduce the likelihood of the clip member 138 slipping out of a user's fingers especially when wet. In this manner, the clip member 138 may be used to leverage and manipulate the hydration reservoir 100 during filling, and also during insertion into and extraction from the backpack.

Figure 4:
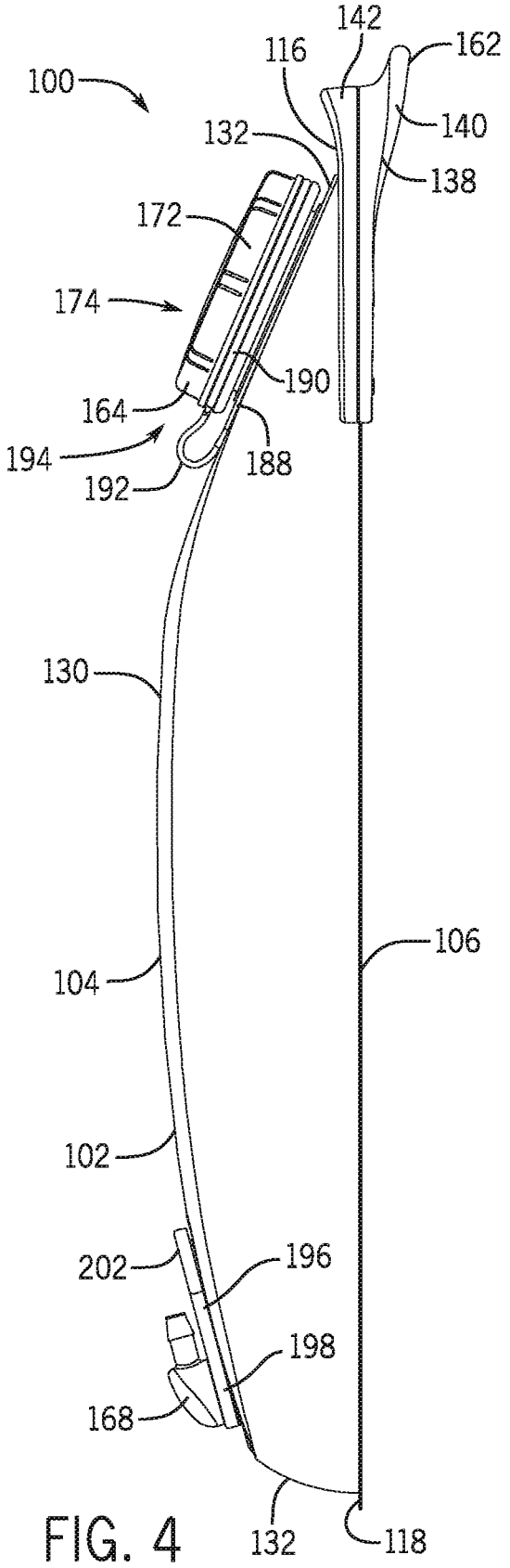
FIG. 4 is a side elevation view of the hydration reservoir of FIG. 1 in accordance with some examples of the present disclosure.

With reference to FIGS. 1-4, the first and second members 140, 142 of the clip member 138 may be ergonomically shaped to fit comfortably within a user's hands and/or fingers. For example, each of the first and second members 140, 142 may be curved in relation to a plane defined by the rear panel 106 of the bladder 102. For example, as best illustrated in FIG. 4, the first and second members 140, 142 curve away from each other such that the first member 140 curves away from, and the second member 142 curves toward, the front panel 104. In this manner, the first and second members 140, 142 of the clip member 138 may be easier to grip and to grasp.

Figure 5:
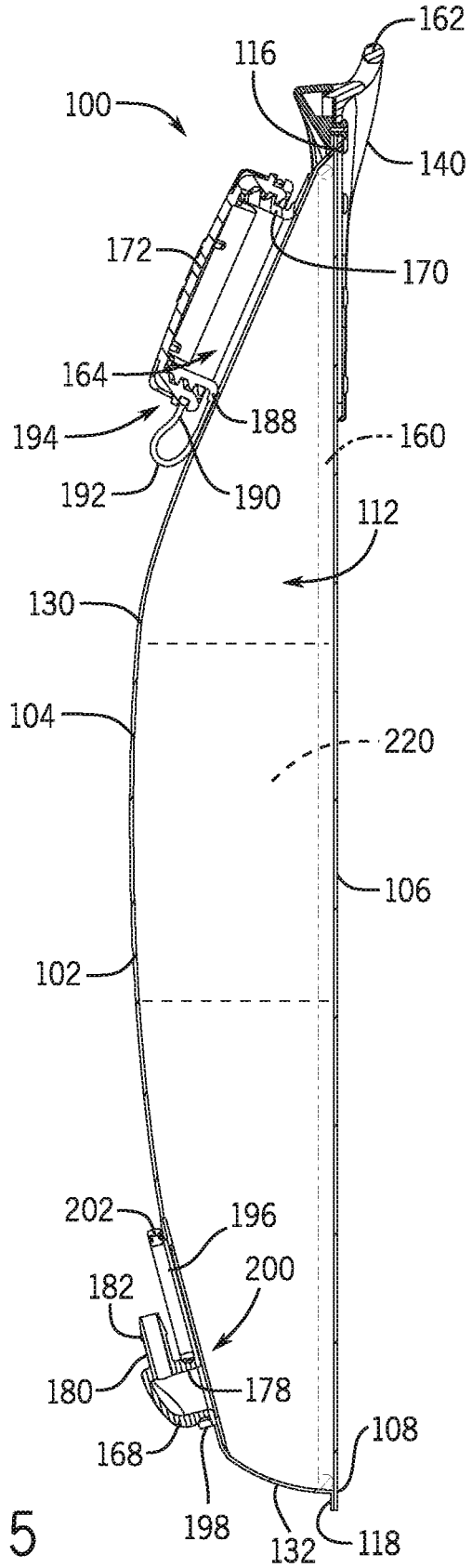
FIG. 5 is a cross-sectional view of the hydration reservoir of FIG. 1 taken along line 5-5 of FIG. 2 in accordance with some examples of the present disclosure.
Figure 9:
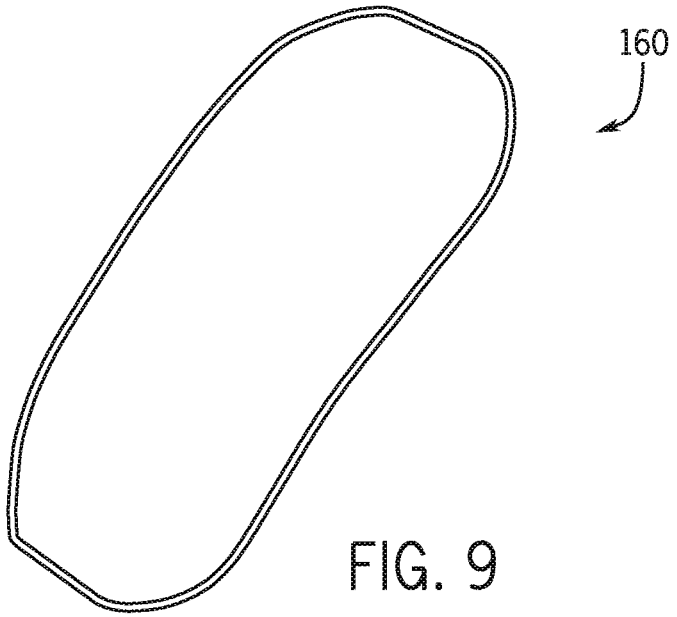
FIG. 9 is a perspective view of a perimeter frame in accordance with some examples of the present disclosure.
Figure 10:
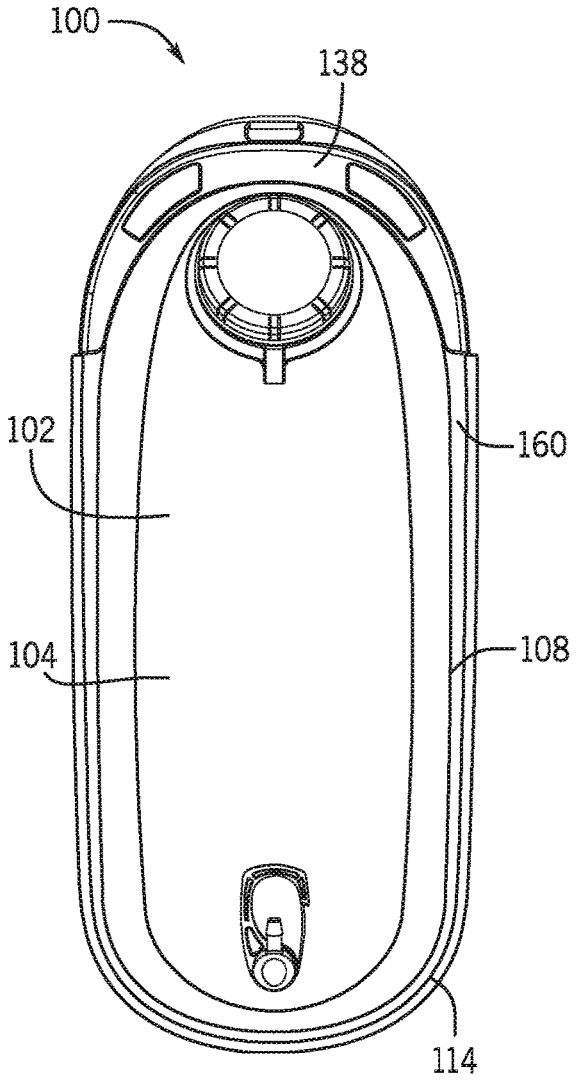
FIG. 10 is a front elevation view of an additional hydration reservoir in accordance with some examples of the present disclosure.
Figure 11:
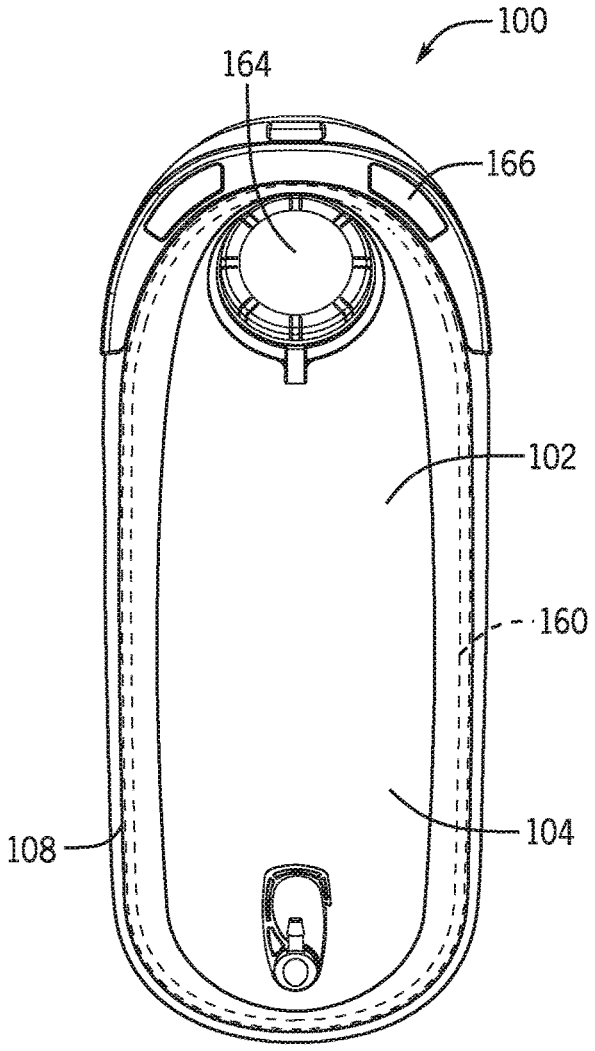
FIG. 11 is a front elevation view of an additional hydration reservoir in accordance with some examples of the present disclosure.

With reference to FIGS. 9-11, the optional perimeter frame 160 may support and/or help define or maintain the shape of the bladder 102, such as by increasing the structural strength around at least a portion of the periphery of the bladder 102. It may be positioned interior to or exterior to the bladder 102. As shown in FIG. 10, the perimeter frame 160, which may be a flexible wire or a molded plastic continuous or discontinuous loop, is positioned exterior to the bladder 102 and extends adjacent the periphery of the bladder 102 defined by the engagement line 108 between the front and rear panels 104, 106 (i.e., adjacent to the flange 114). It may extend underneath the clip member 138, or may terminate at the clip member 138. In some embodiments, the perimeter frame 160 is attached to the flange 114 with a sewn hem or binding, welding, or many other types of suitable attachment mechanisms. In other embodiments, such as in FIG. 11, the perimeter frame 160 may be positioned within the interior of the bladder 102. For example, the perimeter frame 160 may be resiliently deformable and preferably inserted within the interior of the bladder 102, such as in one example through the fill opening 164 of the bladder 102. In some embodiments, the perimeter frame 160 may be inserted within the bladder 102 after the front panel 104 is attached to the rear panel 106 or may be used to provide structural support to existing reservoir arrangements on the market. As best seen in FIGS. 5 and 6A, once positioned within the interior of the bladder 102, the perimeter frame 160 may extend adjacent the engagement line 108, at least partially about the periphery of the bladder, in abutting relationship with the rear panel 106 and the side panel portions 132 and/or the center panel portion 130 of the front panel 104. The perimeter frame 160 may extend substantially parallel to, and in some embodiments substantially contiguous with, the rear panel 106 adjacent the top edge 116, the bottom edge 118, and the opposing side edges 120 of the bladder 102. In such embodiments, the perimeter frame 160 may bias the side panel portions 132 and/or the center panel portion 130 outward to maintain the rear panel 106 in a taut condition. As illustrated in FIG. 9, the perimeter frame 160 may curve along its length dimension (i.e., between the top edge 116 and the bottom edge 118 of the bladder 102) to induce a curvature within the bladder 102 to at least partially match the curvature of a hydration pack 110 and/or a user's back. In some embodiments, the perimeter frame 160 may be selectively removed, for instance, for cleaning and/or to selectively increase the deformability of the bladder 102 in general. In each of the described embodiments above, the perimeter frame 160 may enhance the stiffness of the bladder along its length, support the peripheral shape of the bladder, thus allowing the reservoir to be slid more easily into a confined or tight space of a hydration pack 110 or other carrier, and may also limit the rear panel 106 from expanding toward a user's back by maintaining the shape of the flange 114.

Figure 2A:
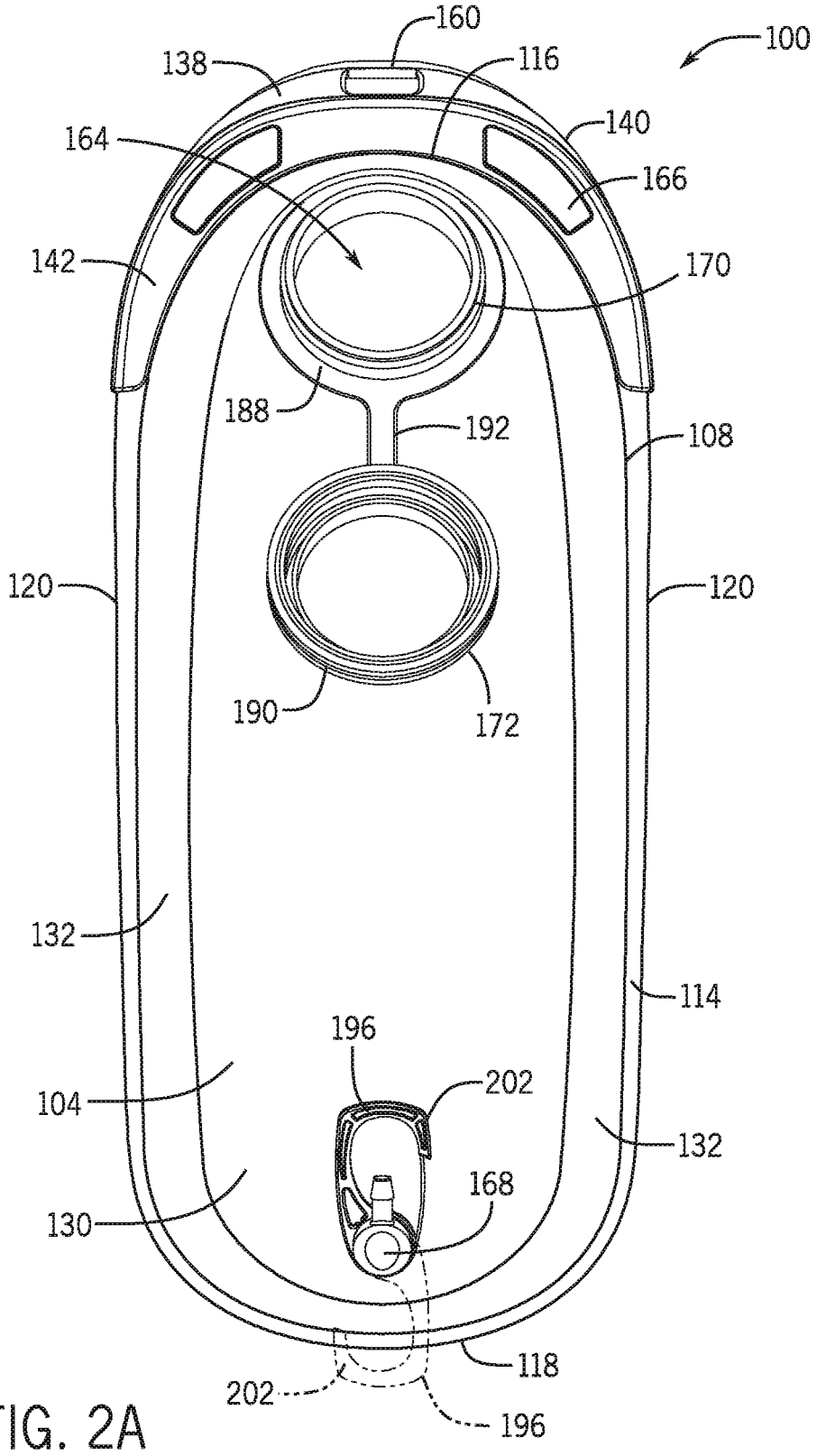
FIG. 2A is a front elevation view of the hydration reservoir of FIG. 1 with a cap in an open position in accordance with some examples of the present disclosure.

With reference to FIGS. 1 and 2, the hydration reservoir 100 may include a fill opening 164 and an outlet port 168 spaced away from the fill opening 164. As shown, the fill opening 164 and the outlet port 168 are defined on the front panel 104 (e.g., in the center panel portion 130) near opposite ends of the bladder 102. The fill opening 164 is defined in the front panel 104 adjacent (e.g., relatively close to but spaced away from) the top edge 116 of the bladder 102. The fill opening 164 may define a periphery from which an annular collar 170 extends outwardly away from the front panel 104 (see FIGS. 2A and 4A). A cap 172 is releasably securable to the fill opening 164 (i.e., to the collar 170) by a securement mechanism 174. Examples of suitable securement mechanisms may include a quick-release threaded mechanism (e.g., one-quarter turn to close or open), a press-fit "plug" connection, or a continuous progressive closure "snap-fit" structure, among others. When the cap 172 is engaged with the fill opening 164, the cap 172 may face an angle (e.g., about 30-60 degrees) relative to the plane of the rear panel 106 (see FIG. 4). The cap 172 may be a standardized cap having a diameter of approximately 63 mm or 80 mm, and in any event is suitable to form a removable cover to seal the fill opening 164.

Continuing to refer to FIGS. 1 and 2, the outlet port 168, which may be operable to connect to an outlet hose 176, may be defined in the front panel 104 adjacent (e.g., relatively close to but spaced away from) the bottom edge 118 of the bladder 102. In one embodiment, the outlet port 168 includes a first section 178 extending outwardly from the front panel 104 of the bladder 102. In such embodiments, a second section 180 may extend from the first section 178 of the outlet port 168 and, in some embodiments, towards the fill opening 164. As illustrated, the second section 180 may extend generally perpendicular to the first section 178 to position the outlet hose 176, when connected thereto, adjacent the front panel 104 of the hydration reservoir 100, for instance. The second section 180 may include a barbed fitting 182 for connecting to the outlet hose 176, though other types of connection mechanisms may be used to secure the outlet hose 176 to the outlet port 168, including without limitation a quick-connect mechanism, a quick-release threaded mechanism (e.g., one-quarter turn to close or open), a press-fit "plug" connection, or a continuous progressive closure "snap-fit" structure, among others. In one embodiment, a quick-connect mechanism may be positioned at any given point along the length of the outlet hose 176 to provide, for instance, an in-line quick-disconnect feature. In some embodiments, the outlet port 168 is secured to the front panel 104 and includes a surrounding shroud layer 184 of resilient material, such as a thicker/tougher plastic layer, formed on the hydration reservoir 100 to shield the bladder material surrounding the outlet port 168 from damage, as explained in more detail below.

In some embodiments, an anchor mechanism 186 may retain the cap 172 adjacent the fill opening 164 when the bladder 102 is being filled with liquid, for instance. In some embodiments, the anchor mechanism 186 may resiliently deform (e.g., bend) to position the cap 172 between a first position in which the securement mechanism 174 is disengaged and the cap 172 is no longer attached to the collar 170 around the fill opening 164 (see FIGS. 2 and 4), and a second position in which the cap 172 extends away from, or is otherwise spaced away from, the fill opening 164 (see FIGS. 2A and 4A). The anchor mechanism 186 may be resilient to automatically position the cap 172, once the securement mechanism 174 is disengaged and the cap 172 is no longer attached to the collar 170, to the second position to allow for easy access to the fill opening 164. In the second position, the anchor mechanism 186 may retain the cap 172 in a position spaced away from the fill opening 164. In some embodiments, at least a portion of the anchor mechanism 186 may at least partially surround the collar 170 and rotate about the fill opening 164 to allow positioning of the cap 172 in substantially any circumferential position relative to the fill opening 164. For example, at least a portion of the anchor mechanism 186 may rotate about the fill opening 164 to position the cap 172 spaced away from the fill opening 164 towards one of the top edge 116, the bottom edge 118, or one of the opposing side edges 120 when in the second position (see FIGS. 2A and 4A).

Figure 4A:
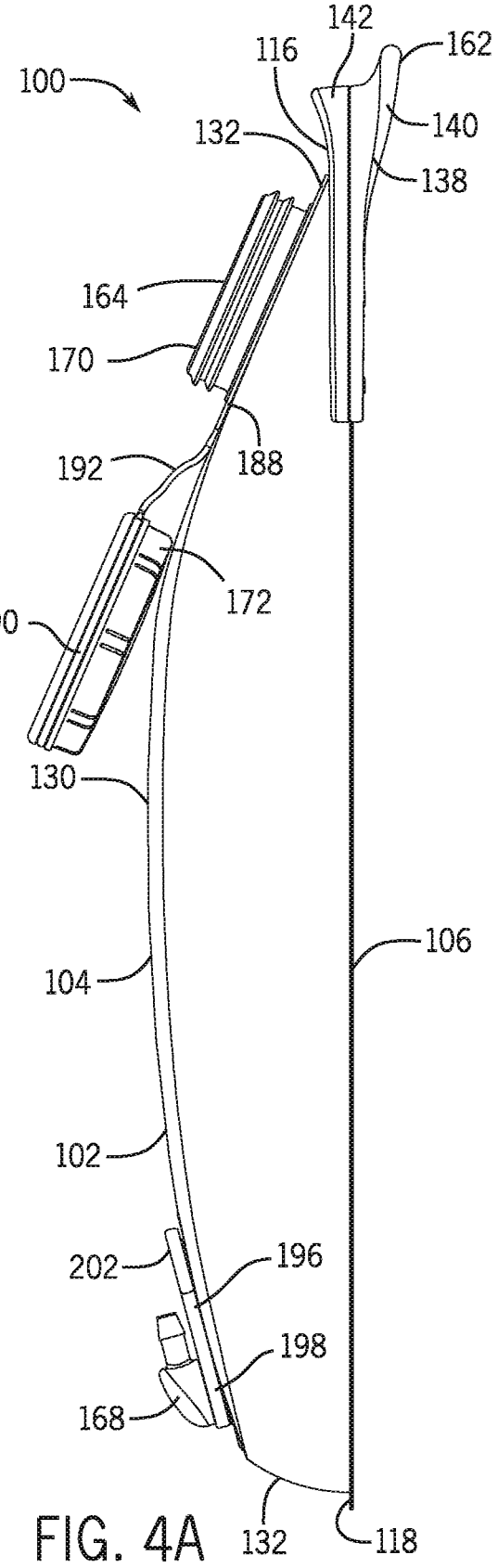
FIG. 4A is a side elevation view of the hydration reservoir of FIG. 1 with a cap in an open position in accordance with some examples of the present disclosure.

With continued reference to FIGS. 1 and 2, in one embodiment, the anchor mechanism 186 may include a first portion 188 connected to (e.g., substantially surrounding) the fill opening 164, a second portion 190 connected to (e.g., substantially received around or surrounding) the cap 172, and a tether 192 connected between the first and second portions 188, 190. Each of the first and second portions 188, 190 may be an annular ring rotatably received about the collar 170 and the cap 172, respectively. In such embodiments, the second portion 190 may be rotatably received within a groove 194 defined in the outer periphery of the cap 172 (see FIG. 5). In one embodiment, the first portion 188 may rotate about a portion of the fill opening 164 (e.g., about the collar 170). Additionally or alternatively, the second portion 190 may rotate about the cap 172 within the groove 194 to permit the cap 172 to engage and seal the fill opening 164, as explained below. The tether 192 may be an elongated strip of resilient material, such as a strap, having a length extending between the first and second portions 188, 190, a transverse width, and a thickness such that the strap may be considered narrow and thin. In the first position, the tether 192 may bend along its length to position the first portion 188 adjacent the second portion 190 and permit the cap 172 to engage and seal the fill opening 164 (see FIG. 4). As shown in FIG. 4A, the tether 192 may resiliently unbend to position the cap 172 in the second position.

To open the bladder 102, a user may, for example, rotate the cap 172 about the collar 170 until the securement mechanism 174 is disengaged and the cap 172 is in the first position. In some embodiments, the second portion 190 of the anchor mechanism 186 may rotate about the cap 172 and/or the first portion 188 of the anchor mechanism 186 may rotate about the collar 170 to permit disengagement of the securement mechanism 174, for instance. Once the cap 172 is in the first position, the user may position the cap 172 away from the fill opening 164 until, for example, the cap 172 is substantially in the second position. In some embodiments, at least a portion of the anchor mechanism 186 (e.g., the tether 192) may itself bias the cap 172 to the second position. For instance, the tether 192 may include a natural spring such that the cap 172 auto-flips away from the fill opening 164 for one-handed or hands-free filling of the hydration reservoir 100. In such embodiments, once the cap 172 is in the first position, a user may release the cap 172 for the cap 172 to spring open to the second position.

Securing the cap 172 to the collar 170 may be accomplished in substantially reverse order as that described above. For example, a user may first position the cap 172 from the second position to the first position by overcoming the bias provided by the tether 192. Once the cap 172 is in the first position, the user may rotate the cap 172 about the collar 170 until the cap 172 is secured to and seals the fill opening 164. Similar to above, when securing the cap 172 to the collar 170, the second portion 190 of the anchor mechanism 186 may rotate about the cap 172 and/or the first portion 188 of the anchor mechanism 186 may rotate about the collar 170 to permit engagement of the securement mechanism 174.

With continued reference to FIGS. 1 and 2, the hydration reservoir 100 may include a securement member 196 for conveniently hanging the hydration reservoir 100, such as for drying it out. In some embodiments, the securement member 196 includes a base 198 defining an aperture 200 therethrough (see FIG. 5), and an engagement portion 202 positioned distal the base 198. As detailed below, the engagement portion 202, which may be a hook, a loop, or an oval or circle hoop, among other effective shapes, is operable to secure the hydration reservoir 100 to a support member (e.g., a hanger, coat or closet hook, etc.). As shown in the embodiments of FIGS. 1 and 2, the securement member 196 (e.g., the base 198) is rotatably mounted to the outlet port 168 and is operable to rotate with respect to the outlet port 168 and the bladder 102. For example, as shown in FIG. 5, the securement member 196 may be rotatably mounted to the first section 178 of the outlet port 168. In such embodiments, the first section 178 may be received within the aperture 200 of the securement member 196 such that the securement member 196 is rotatable relative thereto. To secure the securement member 196 to the outlet port 168, the securement member 196 may be positioned at least partially between the front panel 104 and the second section 180 of the outlet port 168. In such embodiments, the securement member 196 may extend generally parallel to the front panel 104.

In some embodiments, the securement member 196 may rotate about the outlet port 168 between a retracted, storage position (see solid lines in FIG. 2) and an extended, use position (see phantom lines in FIG. 2). In the retracted, storage position, the securement member 196 may be rotated relative to the outlet port 168 such that at least a portion of the securement member 196 is positioned substantially between the outlet port 168 and the fill opening 164. In the retracted, storage position, the securement member 196 may be positioned flush against or otherwise engage the shroud 184 to, for example, shield the bladder 102 from being damaged by the securement member 196 laying against it when stored. In the extended, use position, the securement member 196 may be rotated relative to the outlet port 168 such that a portion of the securement member 196 extends towards the bottom edge 118 of the bladder 102. In this manner, the securement member 196 provides the user a quick mechanism to hang the hydration reservoir 100 from a support member (e.g., a hanger, coat or closet hook, etc.). In some embodiments, the engagement between the outlet port 168 and the securement member 196 may selectively retain the securement member 196 in a select position (e.g., in either the retracted, storage position or the extended, use position). For example, the engagement between the base 198 of the securement member 196 and the first section 178 and/or the second section 180 of the outlet port 168 may define a detent structure (e.g., corresponding ribs and grooves, corresponding tabs and recesses, etc.) such that the securement member 196 "clicks" into place in a select position, such as either the retracted, storage position, the extended, use position, or both.

In some embodiments, the securement member 196 may rotate about the first section 178 of the outlet port 168 in any direction and to any rotational degree. However, it is contemplated that the securement member 196 may rotate in only a first direction (e.g., clockwise in FIG. 2) from the retracted storage position to the extended use position. In such embodiments, the securement member 196 may rotate in only a second direction (e.g., counterclockwise in FIG. 2) from the extended, use position to the retracted, storage position, the second direction being opposite the first direction. Although shown associated with a hydration reservoir 100 having a soft-molded front panel 104, the securement member 196 may be used on any other type of reservoir where hang drying the reservoir from an outlet port is desired.

Figure 13:
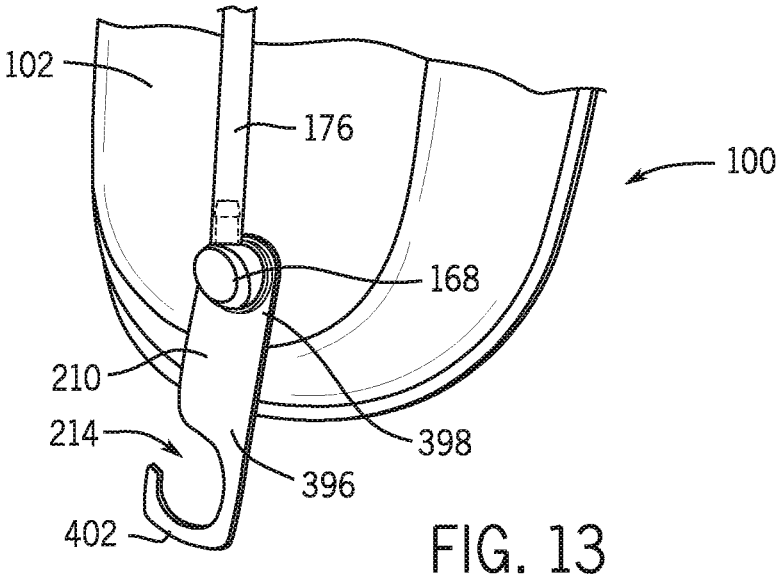
FIG. 13 is a perspective view of an additional securement member in a use position in accordance with some examples of the present disclosure.
Figure 14:
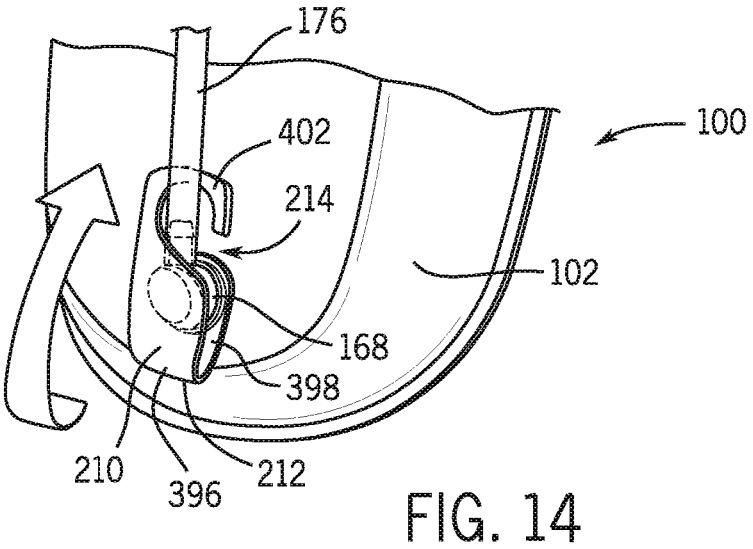
FIG. 14 is a perspective view of the securement member of FIG. 13 in a stored position in accordance with some examples of the present disclosure.

Though the securement member 196 is described above as rotating about the outlet port 168, it is contemplated that the securement member 196 may take on substantially any form operable to hang-dry the hydration reservoir 100 from adjacent the outlet port 168. For example, FIGS. 13 and 14 illustrate an additional embodiment of a securement member 396. Like the securement member 196 discussed above, the securement member 396 is movable between a stored position (see FIG. 14) and a use position (see FIG. 13). In general, the securement member 396 is similar to the securement member 196 and its associated description above and thus, in certain instances, descriptions of like features will not be discussed when they would be apparent to those with skill in the art in light of the description above in view of FIGS. 13 and 14. For ease of reference, like structure is represented with appropriately incremented reference numbers.

With reference to FIGS. 13 and 14, the securement member 396 may be resiliently moved, such as folded, towards or away from the outlet port 168 between a folded, stored position (see FIG. 14) and an unfolded, use position (see FIG. 13), respectively. For example, as illustrated in FIGS. 13 and 14, the securement member 396 may have a generally elongated rectangular shape having a first end (e.g., base 398) rotatably secured to the outlet port 168 in similar fashion as described above with reference to securement member 196. In the embodiments of FIGS. 13 and 14, the securement member 396 includes a body 210, which may be elongated to include a narrower width. In some embodiments, the securement member 396 may be thin to facilitate movement of the securement member 396 between folded and unfolded positions, for instance. Referring to FIG. 14, in one embodiment, the securement member 396 includes an engagement portion 402 positioned distal the base 398 and configured to engage a portion of the hydration reservoir 100 (e.g., the outlet hose 176) to define the stored position, as explained below.

Like the engagement portion 202 described above, the engagement portion 402 may include a hook or other effective shape to secure the securement member 396 to the outlet hose 176. For example, to position the securement member 396 in the stored position, the securement member 396 may be reduced in size by resiliently folding the securement member 396 along a line 212 (e.g., a fold line, a pivot line, a living hinge, or a hinge mechanism) extending transverse to the length of the securement member 396. The securement member 396 may be retained in the stored position by positioning at least a portion of the engagement portion 402 between the outlet hose 176 and a surface of the bladder 102 along which the outlet hose 176 closely extends, with the outlet hose 176 extending through an opening 214 formed by the engagement portion 402. To extend the securement member 396 to its unfolded "use" position, the engagement portion 402 is disengaged from the outlet hose 176, and the securement member 396 is extended to its full length as the securement member 396 unfolds about its fold or pivot line 212. Once extended to its unfolded "use" position, the securement member 396 may be used to secure the hydration reservoir 100 to a support member (e.g., a hanger, coat or closet hook, etc.), such as by securing the engagement portion 402 the support member.

Figure 15:
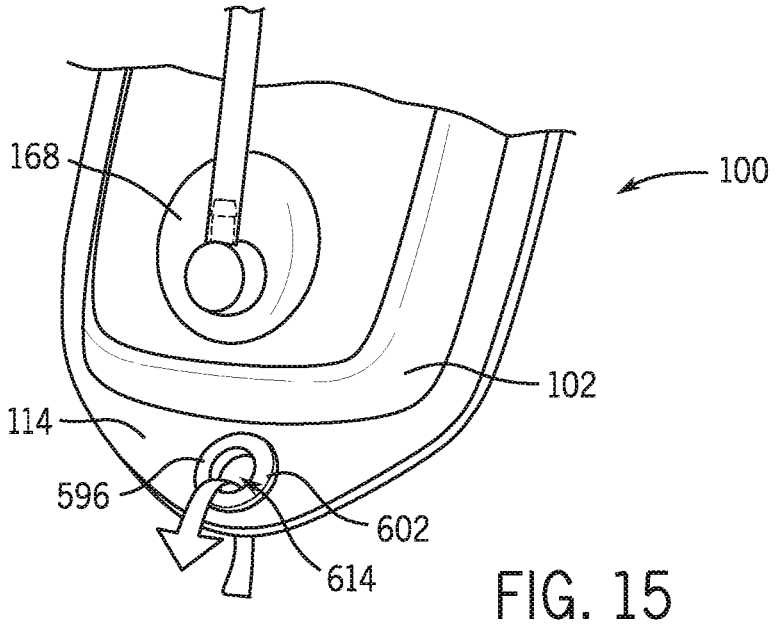
FIG. 15 is a fragmentary, perspective view of an additional securement member in accordance with some examples of the present disclosure.
Figure 16:
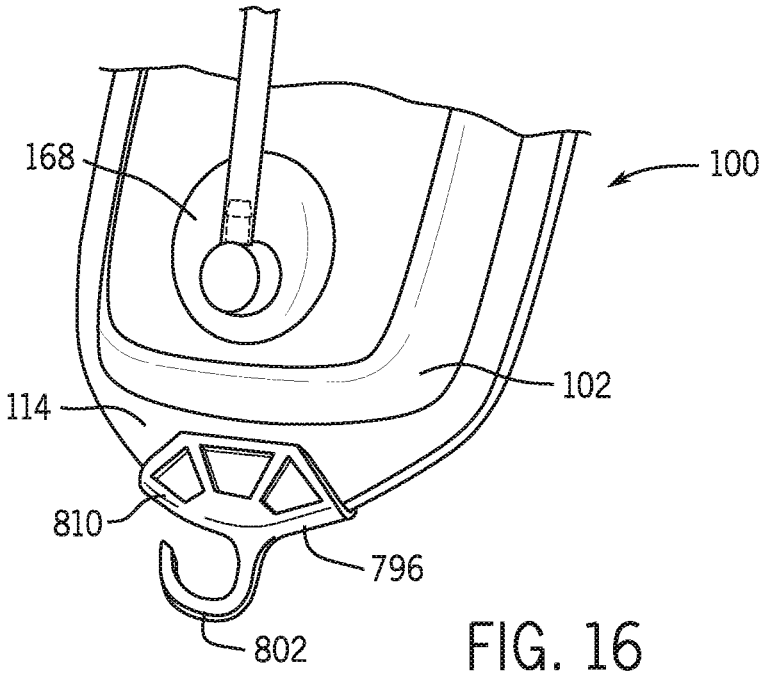
FIG. 16 is a fragmentary, perspective view of an additional securement member in accordance with some examples of the present disclosure.

In some embodiments, the securement member may be secured (e.g., attached) to other portions of the bladder 102 (e.g., the rear panel 106, along the perimeter of the bladder 102, as part of the perimeter structure of the lower portion of the hydration reservoir 100, etc.) in a substantially non-rotatable and/or in a substantially non-foldable manner. For example, FIGS. 15 and 16 illustrate additional embodiments of a securement member 596, 796, respectively. Like the securement members 196, 396 discussed above, the securement members 596, 796 are secured to the hydration reservoir 100 in a manner to hang-dry the hydration reservoir 100 from adjacent the outlet port 168. In general, the securement members 596, 796 are similar to the securement members 196, 396 and their associated description above and thus, in certain instances, descriptions of like features will not be discussed when they would be apparent to those with skill in the art in light of the description above in view of FIGS. 15 and 16. For ease of reference, like structure is represented with appropriately incremented reference numbers.

Referring to FIGS. 15 and 16, the securement members 596, 796 may be secured to the flange 114 of the bladder 102 adjacent the outlet port 168. As shown in FIG. 15, the securement member 596 may be a grommet molded or inserted within the flange 114 of the bladder 102. In such embodiments, the engagement portion 602 may define the securement member 596 itself. For example, the engagement portion 602 may be ring-shaped defining an opening 614 therein operable to hang-dry the hydration reservoir 100 therefrom. Though the opening 614 is shown as circular, the opening 614 may be any shape, including polygonal or elliptical, depending on the particular application.

As illustrated in FIG. 16, in some embodiments, the securement member 796 may be a clip member molded or secured onto the film material of the flange 114, such as part of the perimeter structure of the lower portion of the bladder 102. In one embodiment, the securement member 796 includes a body 810 secured to the flange 114 of the bladder 102, such as in clamping engagement with the film material defining the flange 114. An engagement portion 802 extends from the body 810 and may include a hook or other effective shape to secure the hydration reservoir 100 to a support member (e.g., a hanger, coat or closet hook, etc.) for hang-drying the hydration reservoir 100 from adjacent the outlet port 168. The securement member 796 may be substantially rigid or may be at least partially flexible to facilitate at least partial movement of the engagement portion 802 to secure the securement member 796 to the support member. In some embodiments, each of the engagement portions 602, 802 of the securement members 596, 796, respectively, may be associated with the hydration reservoir 100 in a non-movable manner.

Figure 6B:
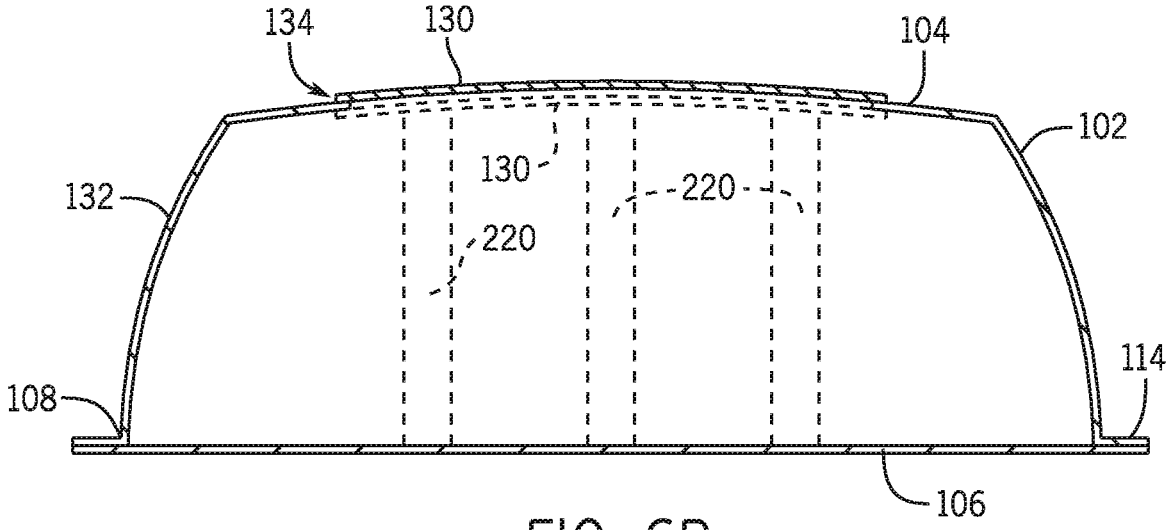
FIG. 6B is a cross-sectional view of the hydration reservoir of FIG. 1 taken along line 6B-6B of FIG. 2 in accordance with some examples of the present disclosure.

With reference to FIGS. 5-6B, for instance, the hydration reservoir 100 may include at least one internal baffle 220 to limit barreling or sloshing of liquid within the bladder 102. For example, as may be seen in FIGS. 6A and 6B, the hydration reservoir 100 may include a single or a multi-baffle (e.g., a dual-baffle) design to provide a desired functional and/or aesthetic characteristic. In embodiments having a multi-baffle design, the internal baffles 220 may extend in various orientations relative to one another. For example without limitation, the internal baffles 220 may extend substantially parallel to one another, may converge towards one another, or may diverge away from one another depending on a particular application. In some embodiments, each of the internal baffles 220 may extend in an arc within the interior of the bladder 102. As shown in FIG. 5, the internal baffle(s) 220 may extend longitudinally at least partially between the fill opening 164 and the outlet port 168, and may be connected to the front and rear panels 104, 106 (e.g., between the center panel portion 130 and the rear panel 106). Like the front and rear panels 104, 106, the internal baffle(s) 220 may be formed from one or more layers of soft film, and may be formed monolithically with at least one of the front and rear panels 104, 106. In some embodiments, the internal baffle(s) 220 may be operable to limit and/or define the space 112 between the front and rear panels 104, 106 of the bladder 102. For example, the internal baffle(s) 220 may help define the overall three-dimensional shape of the bladder 102. When the bladder 102 is filled with liquid, the internal baffle(s) 220 may limit the bladder 102 from bulging outward or barreling away from either the rear panel 106, the front panel 104, or both the front and rear panels 104, 106.

With reference to FIG. 12, the hydration reservoir 100 may include other convenience features. For example, the hydration reservoir 100 may include a carry handle 222 connected adjacent the fill opening 164. In some embodiments, the carry handle 222 may be fixed relative to the fill opening 164 and/or the bladder 102 and may be at least partially positioned between the fill opening 164 and the outlet port 168. In some embodiments, the outlet port 168 may include a bottom screw cap 224 to releasably seal the outlet port 168 when the outlet hose 176 is disconnected from the outlet port 168. In some embodiments, both the cap 172 and the bottom screw cap 224 may include a friction-enhancing over-mold to provide better grip for a user. In some embodiments, the hydration reservoir 100 may include a mouthpiece 226 (e.g., a bite-valve) connected to the outlet hose 176 to selectively deliver liquid to a user (see FIG. 1).

The hydration reservoir 100 may be formed from a variety of materials and means. For example, the bladder 102, including the front and rear panels 104, 106 and the internal baffle 220, if any, may be formed from metallocene, thermoplastic polyurethane, or a combination of polyurethane and polyethylene, and may or may not be treated with an anti-bacterial treatment. The clip member 138, outlet port 168, cap 172, securement member 196, and carry handle 222 may be formed from a thermoplastic material (self-reinforced or fiber reinforced), LDPE, ABS, polycarbonate, polypropylene, polystyrene, PVC, polyamide, and/or PTFE, among others, and may be formed or molded in any suitable manner, such as by plug molding, blow molding, injection molding, or the like. Additionally, the thicknesses of the front and rear panels 104, 106 may be consistent, or may vary across the bladder 102 depending on the desired flexibility, strength, and/or weight of the bladder 102. For instance, the thicknesses of the front and rear panels 104, 106 may be greater near the edges, the fill opening 164, and/or the outlet port 168. Similarly, the thicknesses of the center panel portion 130 and the side panel portions 132 may vary depending on a desired aesthetic or functional characteristic of the bladder 102.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A hydration reservoir comprising:

a flexible bladder formed from one or more layers of flexible film, the flexible bladder having a top peripheral edge and opposing side edges extending from the top peripheral edge, wherein one or more retention holes are defined along at least one of the peripheral top edge and side edges of the bladder and through the one or more layers of film; and a clip member connected to the top peripheral edge of the bladder, the clip member extending along at least the top peripheral edge of the bladder, wherein:

the clip member comprises first and second members secured together, and a portion of at least one of the first and second members of the clip member extends through the one or more retention holes defined through the one or more layers of film to secure the clip member to the bladder and to secure the first and second members together.

2. The hydration reservoir of claim 1, further comprising a hanger element formed in the clip.

3. The hydration reservoir of claim 1, wherein:

the first member comprises a plurality of projections; and the second member comprises a plurality of cavities sized to receive the plurality of projections, wherein the top edge and at least a portion of the opposing side edges of the bladder are positioned substantially between the first and second members, and wherein the plurality of projections are releasably retained in the plurality of cavities to secure the first member to the second member.

4. The hydration reservoir of claim 1, wherein the bladder includes a fill opening spaced away from the top edge of the bladder.

5. The hydration reservoir of claim 1, wherein the first and second members curve away from each other in relation to a plane defined by a rear panel of the bladder.

6. The hydration reservoir of claim 1, further comprising an internal baffle positioned within the bladder.

7. The hydration reservoir of claim 1, wherein: the flexible bladder is formed of at least a front panel and a rear panel that are deformable as the flexible bladder is emptied of liquid;

and the front panel is molded into a three-dimensional shape, the three-dimensional shape of the front panel biasing the front panel away from the rear panel to create a space therebetween.

8. The hydration reservoir of claim 1, wherein each of the front and rear panels is molded into a three-dimensional shape.

9. The hydration reservoir of claim 1, further comprising a cap releasably securable to a fill opening by the securement mechanism.

* * * * *